US005224711A

United States Patent [19]

Dresser

[11] Patent Number: 5,224,711

[45] Date of Patent: Jul. 6, 1993

[54] SEQUENCE OF MOTION BOARD GAME

[76] Inventor: Matthew W. Dresser, 1415 N. Hwy. A1A - Unit 56, Indialantic, Fla. 32903

[21] Appl. No.: 849,164

[22] Filed: Mar. 10, 1992

[51] Int. Cl.[5] ..... A63F 3/00

[52] U.S. Cl. ..... 273/277; 273/275; 273/298; 273/308

[58] Field of Search ..... 273/308, 292, 293, 294, 273/296, 298, 299, 302, 306, 275, 276, 277

[56] References Cited

U.S. PATENT DOCUMENTS

| | | | |
|---|---|---|---|
| 471,666 | 3/1892 | Doty | 273/275 |
| 1,676,641 | 7/1928 | Eschenbach | 273/157 R |
| 3,159,450 | 12/1964 | Brambier | 273/296 |
| 3,309,092 | 3/1967 | Hardesty et al. | 273/157 R |
| 3,453,746 | 7/1969 | Cartwright | 273/298 |
| 4,180,271 | 12/1979 | McMurchie | 273/275 |

*Primary Examiner*—Benjamin H. Layno

*Attorney, Agent, or Firm*—Evenson, Wands, Edwards, Lenahan & McKeown

[57] ABSTRACT

A simulated motion board game in which a player is able to effectively simulate a continuum of sequential motion of one or more subjects contained within scenes of motion individually pictorially depicted on the faces of respective game elements. The representation of a sequence of continuous motion of the subject is independent of the order in which the tiles are placed next to one another. An edge portion of a scene immediately adjacent to the left/right hand edge of one motion tile will always provide a complementary extension of the motion within that portion of the scene immediately adjacent to the right/left hand edge of any other motion tile. As a consequence, even though the particular sequence of continuous motion will depend upon the events depicted in individual ones of the tiles, plural motion tiles placed in side-by-side adjacency with one another will always produce a continuum of motion of the subject traversing the depicted scene.

9 Claims, 1 Drawing Sheet

SEQUENCE OF MOTION BOARD GAME

FIELD OF THE INVENTION

The present invention relates in general to board games and is particularly directed to a game in which a dynamic representation of one or more subjects, in the context of a sequence of continuous motion of the one or more subjects, is constructed by the adjacent placement of playing tiles or cards.

BACKGROUND OF THE INVENTION

There currently exist a variety of games in which players alternately place game elements in the form of tiles, cards, blocks or the like on a playing surface (e.g. game board) adjacent to already played game elements in such a way that a predetermined correlative relationship exists between the played element and the element being played. An example of such a game is "dominoes" in which the number of dots on a portion of the game element (tile) must match the number of dots on a portion of another block in the course of play. Thus, the arrangement of the tiles on the playing surface is such that there is correlative relationship (adjacent matching) between the dot patterns of adjacent dominoes. As dominoes are successively placed on the playing surface, the tile layout forms a random pattern generally consisting of perpendicular and parallel straight lines, depending upon their placement.

Other tile games, such as that described in the U.S. Pat. No. 4,466,615, to Yaeger, employ a plurality of tiles which, when placed next to one another, form an overall representation of a subject, such as a plant, animal, or inanimate object in some static condition. In each of such conventional multi-tile games, the graphics or patterns on the tiles not only differ from one another, but they are varied in such a manner that, in order to properly create an intended overall or combined tile profile, it must initially be determined that the designs on the faces of adjacent tiles will pictorially correlate with one another. In the game of dominoes, for example, adjacent portions of adjacent tiles must have the same number of dots. Similarly, in the 'snake' forming game of the above-referenced Yaeger patent, the manner in which the tiles are placed in adjacency to one another is governed by or dependent upon the geometrical shape and color on the face of a tile.

SUMMARY OF THE INVENTION

In accordance with the present invention there is provided a new and improved board game in which a plurality of tiles, cards, blocks, or the like, are placed next to one another, to create an overall representation of a sequence of continuous motion of one or more subjects contained within scenes of motion pictorially depicted on the faces of the tiles. Moreover, and of particular significance, is the fact that the representation of sequence of continuous motion of the subject is independent of the order in which the tiles are placed next to one another, even though the particular sequence of continuous motion will depend upon the events depicted in individual ones of the tiles.

DETAILED DESCRIPTION

Figure 3:
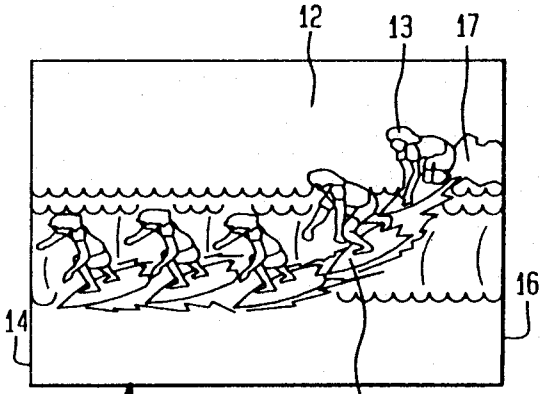
FIGS. 1-4 diagrammatically show non-limitative examples of motion game tiles that may be employed to form an image of a subject in a sequence of continuous motion in accordance with an embodiment of the present invention.

As pointed out briefly above, the present invention is directed to a game in which a plurality of tiles, cards, blocks, or the like, are placed next to one another during the game's course of play for the purpose of creating or simulating an overall representation of a sequence of continuous motion of one or more subjects contained within scenes of motion that are pictorially depicted on the faces of the tiles. Each respective scene of a tile that contains an image of the subject in motion is pictorially formatted such that the representation of continuous motion of the subject across a plurality of adjacently placed tiles is independent of the order in which the tiles are placed next to one another, even though the particular sequence of continuous motion will depend upon the events depicted in individual ones of the tiles.

With reference to FIGS. 1-4, a non-limitative example of the present invention is diagrammatically illustrated as comprising a plurality of game elements 11, in the form of tiles, cards, blocks or the like, each of which may be of generally rectangular configuration to facilitate layout, play and storage. It should be realized, however, that game elements of different shapes and sizes may be employed without departing from the basic functionality and usage of play of the present invention. Pursuant to an essential feature of the present invention, the face 12 of each motion game element contains a pictorial representation of at least one subject in motion across a scene that traverses the face of the game element. The motion of the subject is such that the direction of motion is continuous and traverses the face 12 of the game element from one side or edge 14 to the opposite side or edge 16. In the example illustrated in FIG. 1, the face of each motion game element depicts one or more subjects participating in a sporting event, specifically a surfer 13 riding a surfboard 15 on a wave 17 across the face of the game element.

Figure 2:
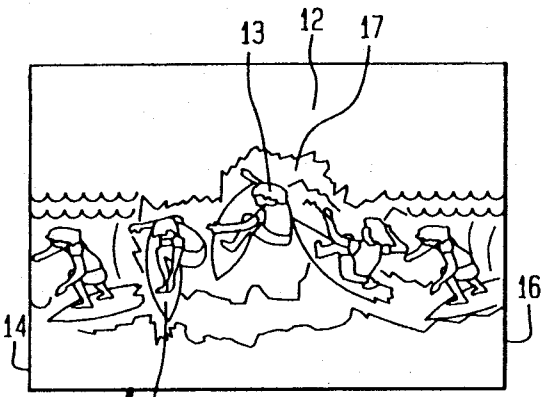
Figure 1:
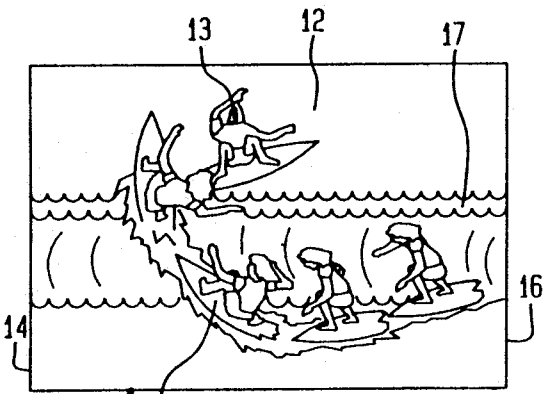
Figure 4:
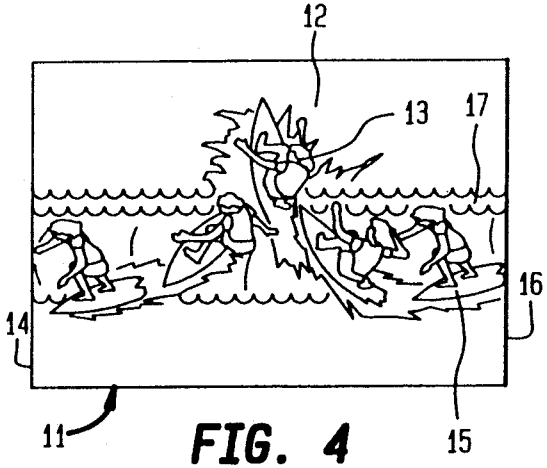

FIGS. 2-4 illustrate non-limitative examples of additional game elements that may be used with the game element illustrated in FIG. 1 in the course of playing the sequential continuous motion game of the present invention. As shown therein, for the example of a surfing scene, the faces the motion game elements of FIGS. 2-4 contain respectively different pictorial representations of surfer 13 riding a surfboard 15 on a wave 17 across the faces of the game elements.

As illustrated in the sequential arrangement of FIGS. 1-3, when plural ones of the game elements are placed in adjacent, edge-to-edge alignment with one another, they create or simulate an overall image of continuous sequential motion of the surfer 13 through a variety of board-riding attitudes, angles of attack, etc. through the wave 17. Namely, an important aspect of the invention is the fact that that portion of the scene immediately adjacent to the left/right hand edge 14/16 of any motion tile provides a continuing extension of the motion in the scene immediately adjacent to the right/left hand edge 16/14 of any other motion tile. As a consequence, even though the particular sequence of continuous motion will depend upon the events depicted in individual ones of the tiles, plural motion tiles placed in side-by-side adjacency with one another will always produce a continuum of motion of the subject traversing the depicted scene. Thus, the representation of a sequence of continuous motion of the subject is independent of the order in which the tiles are placed next to one another.

Figure 5:
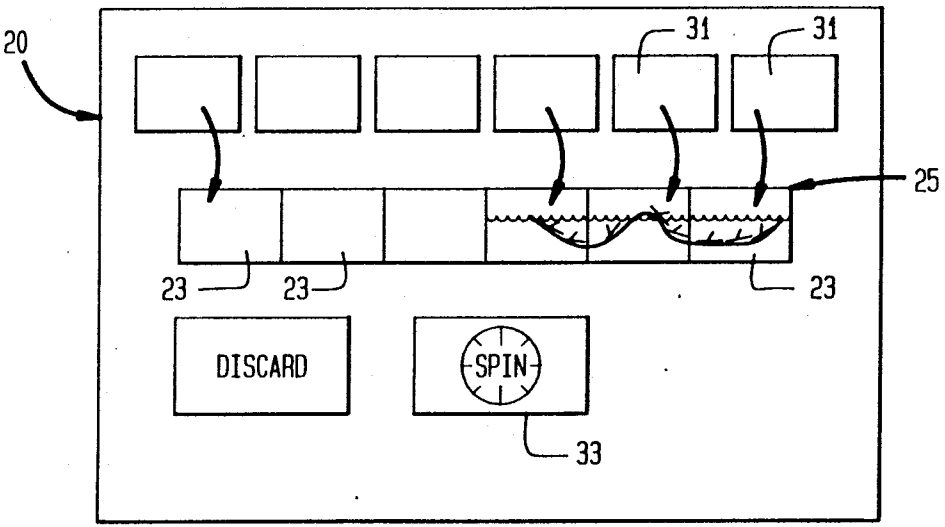
FIG. 5 diagrammatically illustrates an example of a game board that may be used as a game playing surface of the present invention.

FIG. 5 diagrammatically illustrates an example of a game board 20 that may be used as a game playing surface of the present invention. The board includes a generally flat surface 21 containing a plurality of face-up game element placement regions 23 arranged adjacent to one another along a line 25. The number of placement regions is not limited to any particular number, but is sufficient to accommodate a plurality of game elements, such that the placement of respective game elements in a face-up condition on the game element placement regions will result in their pictorial representations forming an overall image of sequential continuous motion of a subject across those respective game elements. Adjacent to the face-up placement regions 23 one or more face-down game element placement regions 31 for the placement of the game elements in a face-down condition may be provided. Plural regions 31 may be provided adjacent to placement regions 23, as shown in FIG. 5, or a elements in a face-down condition ready for sequential play off the top of the stack.

The game also includes an additional game element, such as a blank element, namely a game element the face of which contains a representation different from that of a subject in motion across a scene traversing a face of a motion game element. This additional, blank element, serves as a nemesis element during the course of play. Specifically, placement of the additional blank game element upon one of the game element placement regions 23 that is adjacent to another game element placement region upon which one of the motion game elements has been placed effectively interrupts an overall image of sequential continuous motion of one or more game elements that have been placed upon the game element placement regions. One or more nemesis game elements may be interleaved with the other game elements in a stack, or it may be part of the distribution of the other motion game elements in a face-down condition among the respective placement regions 23 on the playing surface 21 of the game board.

The course of play of the game proceeds by providing the plurality of game elements, such as those shown in FIGS. 1–4, in a face down condition, either in a stack or distributed face-down among a plurality of face-down game element placement regions 31 on the game playing surface 21 of FIG. 5. Through an order of play mechanism such as a spinner 33, dice, etc. the players take turns sequentially turning over game elements from their face-down condition and placing them face-up on the game element placement regions 23. As the game elements are placed in adjacent, edge-to-edge relationship, their pictorial representations will form an overall image of sequential continuous motion of one more subjects (e.g. the surfer 13 riding a wave across the sequentially arranged tiles), as diagrammatically illustrated in FIG. 5 and more clearly shown in the sequence of FIGS. 1–3. Various degrees of scoring may be associated with the continuous motion sequence created, such as points that demarcate the manner of scoring in the simulated athletic event. The nemesis game element in the surfing event of the present example may represent a 'wipe-out', thereby terminating a scoring sequence. It should be realized that various forms of play and scoring may be employed in the course of sequential play of the motion game elements, without departing from the essential feature of a continuum of motion of a subject across of scene pictorially illustrated on the face of each motion game element, so that the continuum of motion traverses multiple ones of the game elements as they are played (placed in edge-to-edge) alignment on the game playing surface.

As will be appreciated from the foregoing description, the present invention provides a new and improved board game in which the player is able to effectively simulate a continuum of sequential motion of one or more subjects contained within scenes of motion individually pictorially depicted on the faces of respective game elements. A significant feature of the present invention is the fact that the representation of a sequence of continuous motion of the subject is independent of the order in which the tiles are placed next to one another. An edge portion of a scene immediately adjacent to the left/right hand edge of one motion tile will always provide a complementary extension of the motion within that portion of the scene immediately adjacent to the right/left hand edge of any other motion tile. As a consequence, even though the particular sequence of continuous motion will depend upon the events depicted in individual ones of the tiles, plural motion tiles placed in side-by-side adjacency with one another will always produce a continuum of-motion of the subject traversing the depicted scene.

While I have shown and described an embodiment in accordance with the present invention, it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed is:

1. An apparatus for playing a game, comprising a playing surface, a plurality of game elements in the form of cards, tiles, blocks or the like, a face of each of which contains a pictorial representation of at least one subject in motion across a scene that traverses the face of the game element, such that a placement of a plurality of game elements in adjacent, edge-to-edge relationship causes their pictorial representations to form an overall image of continuous sequential motion of said at least one subject thereacross wherein the playing surface has plural game element placement regions arranged adjacent to one another in a predetermined unidirectional sequence, so that the placement of respective ones of said plurality of game elements in a face-up condition on said game element placement regions in the unidirectional sequence causes their pictorial representations to form an overall image of sequential continuous motion of said at least one subject thereacross.

2. An apparatus according to claim 1, further including an additional game element, a face of which contains a representation different from that of at least one subject in motion across a scene traversing a face of a game element, whereby placement of said additional game element upon one of said game element placement regions that is adjacent to another game element placement region upon which one of said plurality of game elements has been placed effectively interrupts an overall image of sequential continuous motion of said at least one subject across the face of one or more game elements that have been placed upon said game element placement regions.

3. An apparatus according to claim 1, wherein said representation of at least on subject in motion comprises the depiction of at least one person participating in a sporting event in which the depicted at least one person is travelling from one side of the face of the game element to the other.

4. An apparatus according to claim 1, wherein said representation of at least on subject in motion comprises an image of at least one person riding a surfboard on a wave across the face of said game element.

5. An apparatus according to claim 1, wherein the representation of at least one subject in motion on the face of a respective game element is such that an edge portion of a scene immediately adjacent to the left/right hand edge of one motion game element provides a complementary extension of the motion within that portion of the scene immediately adjacent to the right/left hand edge of another game element, whereby plural game elements placed in side-by-side adjacency with one another will produce a continuum of motion of a subject traversing a depicted scene.

6. A method of playing a game simulating sequential continuous motion of at least one subject comprising the steps of:

(a) providing a plurality of game elements in the form of cards, tiles, blocks or the like, a face of each of which contains a pictorial representation of at least one subject in motion across a scene that traverses the face of the game element;

(b) providing a playing surface having plural game element placement regions arranged adjacent to one another in sequence; and (c) placing game elements from said plurality onto said game element placement regions in a predetermined unidirectional sequence, in adjacent, edge-to-edge relationship, so as to cause their pictorial representations to form an overall image of sequential continuous motion of said at least one subject thereacross.

7. A method according to claim 6, wherein step (a) includes providing an additional game element, a face of which contains a representation different from that of said at least one subject in motion across a scene traversing a face of a game element, and wherein step (c) comprises selecting game elements from said plurality and said additional game element for placement upon one of said game element placement regions that is adjacent to another game element placement region upon which one of said plurality of game elements has been placed, whereby placement of said additional game element on said one of said game element placement regions effectively interrupts an overall image of sequential continuous motion of said at least one subject across the face of one or more game elements that have been placed upon said game element placement regions.

8. A method according to claim 7, wherein said representation of at least on subject in continuous motion comprises an image of at least one person riding a surfboard on a wave across the face of a game element.

9. A method according to claim 6, wherein the representation of at least one subject in motion on the face of a respective game element is such that an edge portion of a scene immediately adjacent to the left/right hand edge of one motion game element provides a complementary extension of the motion within that portion of the scene immediately adjacent to the right/left hand edge of another game element, whereby plural game elements placed in side-by-side adjacency with one another will produce a continuum of motion of a subject traversing a depicted scene.

* * * * *